US007597194B2

(12) United States Patent
Oberliesen et al.

(10) Patent No.: US 7,597,194 B2
(45) Date of Patent: Oct. 6, 2009

(54) SHIPPING CONTAINER WITH INTEGRATED PALLET AND REINFORCED WALL STRUCTURE

(75) Inventors: Eric John Oberliesen, Monroe, MI (US); John Clinton Van Der Kolk, Milan, MI (US)

(73) Assignee: International Paper, Loveland, OH (US)

( * ) Notice: Subject to any disclaimer, the term of this patent is extended or adjusted under 35 U.S.C. 154(b) by 465 days.

(21) Appl. No.: 11/435,311

(22) Filed: May 16, 2006

(65) Prior Publication Data

US 2007/0267308 A1 Nov. 22, 2007

(51) Int. Cl.
*B65D 19/02* (2006.01)

(52) U.S. Cl. ..... 206/386; 206/599; 229/194

(58) Field of Classification Search ..... 206/386, 206/599, 600; 108/51.3, 52.1, 56.1, 57.18, 108/57.29, 57.34; 220/7; 229/190, 194, 229/198.2

See application file for complete search history.

(56) References Cited

U.S. PATENT DOCUMENTS

| | | | | | |
|---|---|---|---|---|---|
| 2,658,660 | A * | 11/1953 | Keller | 229/198.2 |
| 2,993,634 | A * | 7/1961 | Burdette | 229/190 |
| 4,085,847 | A * | 4/1978 | Jacalone | 206/600 |
| 4,326,634 | A * | 4/1982 | Meyers | 229/194 |
| 4,339,069 | A * | 7/1982 | Poteet | 229/194 |
| 5,291,837 | A * | 3/1994 | Adams, Jr. | 108/51.3 |
| 5,595,304 | A | 1/1997 | Timmins | |
| 5,918,744 | A | 7/1999 | Bringard et al. | |
| 6,070,726 | A * | 6/2000 | Graham | 206/386 |
| 7,290,664 | B2 * | 11/2007 | Kono et al. | 206/600 |
| 2006/0076255 | A1 * | 4/2006 | Bragadeste et al. | 206/386 |

FOREIGN PATENT DOCUMENTS

| | | |
|---|---|---|
| BE | 443441 | 12/1941 |
| DE | 7728755 | 1/1978 |
| FR | 79977 | 2/1963 |
| FR | 2057167 | 5/1971 |
| FR | 2798905 | 3/2001 |
| GB | 1240495 | 7/1971 |

* cited by examiner

*Primary Examiner*—Luan K Bui
(74) *Attorney, Agent, or Firm*—Matthew M. Eslami

(57) ABSTRACT

According to one aspect of the invention, a shipping container with an integrated pallet has a narrow width adapted for maximum utilization of the available space in standard sea containers, and openings for the tines of a forklift are spaced so that adjustment of the tines is not necessary in order to fit the narrower container. The container has an open top, opposite end walls, opposite sidewalls, and a bottom wall. The pallet is attached on top of the bottom wall and comprises a pallet deck, with runners secured between the deck and the bottom wall in inwardly spaced relation to the side edges of the container so that the runners are located inside the fork footprint rather than outside the fork footprint. The tine-receiving openings are thus positioned outboard of the runners and under opposite side edges of the container. The opposite side edges of the container between the pallet deck and the bottom wall are reinforced by down-turned flanges on the pallet deck that are secured to an inner surface of the sidewalls. According to another aspect of the invention, confronting flaps form inner wall panels in the sidewalls or the end walls of a container, and interlocking structure on confronting edges of the flaps lock them together to resist separation thereof.

13 Claims, 12 Drawing Sheets

SHIPPING CONTAINER WITH INTEGRATED PALLET AND REINFORCED WALL STRUCTURE

BACKGROUND OF THE INVENTION

1. Technical Field of the Invention

This invention relates to shipping containers, and more specifically to shipping containers having an integrated pallet.

2. Brief Description of the Related Art

Corrugated paperboard containers are commonly used to store and transport a variety of goods. Many of these containers are quite large, holding 2,000 pounds or more of product, and typically are placed on pallets so that the containers may be handled with forklifts or jack trucks and the like. Wooden pallets are used in most conventional systems. These pallets are strong but they also are relatively heavy and expensive and are difficult to transport or recycle after use. Moreover, containers that are stacked upon but not fastened to the pallet may become displaced during handling, thereby causing the forklift operator to waste valuable time in rearranging the containers on the pallet. In extreme cases, the containers may actually fall off the pallet, causing damage to or destruction of the goods being transported.

To avoid these problems, integrated container and pallet constructions have been developed in the prior art. In these constructions the bottom of the container is configured to have a pallet integrated into it, with outboard runners of the pallet extending along the outer side edges of the container, and openings inboard of the outboard runners for receiving the tines of a forklift. Conventional containers of this type usually are dimensioned to fit on a standard 40 inch by 48 inch pallet, and the tines of a forklift normally are set so that they extend through the openings inboard of the outermost runners. This spacing is appropriate for containers having a conventional width, but when narrower containers are used with the foregoing runner construction, i.e., with the outermost runners extending along the outer side edges of the container, the spacing between the tine-receiving openings is smaller than the normal spacing of the forklift tines.

Narrower shipping containers are encountered, for example, in the transportation of goods intended for import or export. Goods intended for import or export typically are placed in shipping containers that are, in turn, stacked in large standardized sea containers for transport on container ships. These sea containers typically have standard lengths of, e.g., 20 feet or 40 feet, and a width of 8.5 feet, with a nominal interior usable width of about 90 inches. To maximize use of the available space in the sea container, a common width for the shipping containers is 30 inches, whereby they can be placed three abreast in the sea container. If these shipping containers have an integrated pallet, with the outboard runners extending along the side edges of the container and the tine-receiving openings inboard of these runners, the tines of a forklift, at their normal spacing, will not correspond to the spacing of the openings, whereby the forklift operator must come down off his machine to adjust the tines to fit the smaller container. In reality this frequently does not happen, with the result that the containers are damaged.

It would be desirable to have a shipping container with integrated pallet, wherein the container has a narrow width adapted for maximum utilization of the available space in standard sea containers, and the openings for the tines of a forklift are spaced so that adjustment of the tines is not necessary in order to fit the narrower container.

SUMMARY OF THE INVENTION

The present invention comprises a shipping container with an integrated pallet, wherein the container has a narrow width adapted for maximum utilization of the available space in standard sea containers, and the openings for the tines of a forklift are spaced so that adjustment of the tines is not necessary in order to fit the narrower container.

The container of the invention has an open top, a bottom wall, opposite end walls, opposite sidewalls, and a separate pallet attached on top of the bottom wall and integrated into the bottom of the container. A separate cover normally is placed over the open top.

The pallet comprises a pallet deck, with runners secured between the deck and the bottom wall of the container in inwardly spaced relation to the side edges of the container so that the runners are located inside the fork footprint rather than outside the fork footprint as in conventional container constructions having an integrated pallet. Openings are provided in the end walls of the container, between the pallet deck and container bottom wall and between the runners and respective adjacent side edges of the container, for receiving the tines of a forklift. The tine-receiving openings are thus positioned outboard of the runners and under opposite side edges of the container, in positions to accept the tines of a forklift at their normal spacing. Accordingly, the tines of a forklift may be left in their normal setting for containers of conventional size, and when used with the container of the invention the tines will extend on the outside of the outermost pallet runners and under opposite side edges of the pallet deck.

Since relocation of the outermost pallet runners inwardly from the side edges of the container can give rise to possible compression issues with the sides of the container, the container and pallet are constructed such that the sides of the container are reinforced. The reinforcement provides strength at the outer side edges of the container, comparable to the strength obtained when runners are located under the side edges as in conventional constructions.

This reinforcement is provided by making the container sidewalls of inner sidewall panels and outer sidewall panels laminated together, and by providing side flanges on the pallet that extend downwardly from opposite side edges of the pallet deck to the container bottom wall and that are attached to the inner sidewall panels, thus forming a triple wall construction extending between the pallet deck and the container bottom at the sides of the container. Further, end flanges extend upwardly from each end of the pallet deck, and these end flanges are secured to the inner surface of the container end walls. The multiple thickness structure provided at the sides of the container by the inner and outer sidewall panels and the pallet side flanges has essentially the same resultant strength that would be provided by locating a pallet runner in this location.

The sidewalls in the container of the invention also are uniquely constructed for increased strength and bulge resistance. In the invention the inner panels of the sidewalls are formed of opposing side flaps meeting at confronting edges at about the midpoint of the respective sidewall. Interengaging locking means on the confronting edges provide a mechanical lock that ties the opposing side flaps together, resisting separation of the opposing side flaps from one another and increasing bulge resistance of the sidewalls.

In one embodiment of the invention, the container and pallet are designed for two-way entry, i.e., the tines of a forklift may be inserted from either of opposite ends of the container, and in another embodiment the container is designed for four-way entry, i.e., the tines may be inserted from either side or either end of the container.

The container sidewalls, bottom wall and end walls are all formed from a single piece or blank of corrugated paperboard, preferably of triple-ply construction. In a preferred embodiment the triple-ply construction comprises 700# CAA flute. The blank comprises a central panel that forms the bottom wall, opposite sidewall panels foldably joined to opposite sides of the bottom panel, opposite end wall panels foldably joined to opposite ends of the bottom panel, and a sidewall flange foldably joined to each of the opposite side edges of each end wall panel. Cut-out openings are provided in each end wall panel at its outer side edge and adjacent to the folded connection with the bottom panel, forming the tine-receiving openings in a container erected from the blank. A shaped cut-out is made in the outer end edge of each side flange on one of the end wall panels, and a correspondingly shaped projection is formed on the outer end edge of each side flange on the other end wall panel, forming the interlocking means that ties the side flanges together in a container erected from the blank.

The pallet deck is made from a single blank of corrugated paperboard, preferably of two-ply construction, with a bendable flange on each end and a bendable flange on each side. In a preferred embodiment, the two-ply construction comprises 350# BC flute. The pallet runners are formed of strips of corrugated material laminated together to form a runner of desired thickness or width, and the cover is formed of a piece of corrugated material, preferably of single-ply construction, and having bendable flanges on each of its opposite side and end edges, with glue flaps on each of the opposite side edges of two of the opposed flanges. In a preferred embodiment, the single-ply construction of the cover comprises 200# C flute.

To erect the container of the invention, runners are adhesively secured to the underside of the pallet deck and to the top of the bottom wall panel of the container blank, with the side flanges on the pallet deck bent downwardly and the end flanges on the pallet deck bent upwardly. Adhesive is applied to the entire inner (or upper) surface of the sidewall panels and to the outer surfaces of the side and end flanges on the pallet deck. The end wall panels are then folded upwardly perpendicular to the bottom panel, with the side flaps folded inwardly parallel to the side edges of the bottom panel and the interlocking means on confronting edges of the side flaps engaged with one another and the side flaps adhesively attached to the outer surfaces of the pallet side flanges and the end wall panels adhesively attached to the outer surfaces of the pallet end flanges. The sidewall panels are then folded upwardly and adhesively secured to the outer surface of the side flaps. Staples or other fasteners may be applied across the top of the sidewall panels and side flanges to hold them in place while the adhesive cures.

It should be understood that the principles of the invention would apply equally as well to flute combinations and weights other than those specifically described herein, and to the use of other materials in the construction of the container. For example, the container and/or pallet could be made of plastic, wood, metal, or other materials, especially in a returnable version of the invention. Also, the container could have sizes and dimensional relationships, i.e., length, width and height ratios, other than those specifically disclosed herein.

Further, the interlocking means on the sidewalls of the container of the invention could be employed independently of the integrated pallet, and/or the inset outboard runners of the integrated pallet of the invention could be employed independently of the interlocking means on the container sidewalls.

These and other objects, features and advantages of the present invention become apparent to those of ordinary skill in the art from the description which follows, and may be realized by means of the instrumentalities and combinations particularly pointed out therein, as well as by those instrumentalities, combinations and improvements thereof which are not described expressly therein, but which would be obvious to those of ordinary and reasonable skill in the art.

BRIEF DESCRIPTION OF THE DRAWINGS

A better understanding of the invention will be had upon reference to the following description in conjunction with the accompanying drawings in which like reference numerals represent like parts, and wherein.

DETAILED DESCRIPTION OF THE PREFERRED EMBODIMENTS

Figure 1:
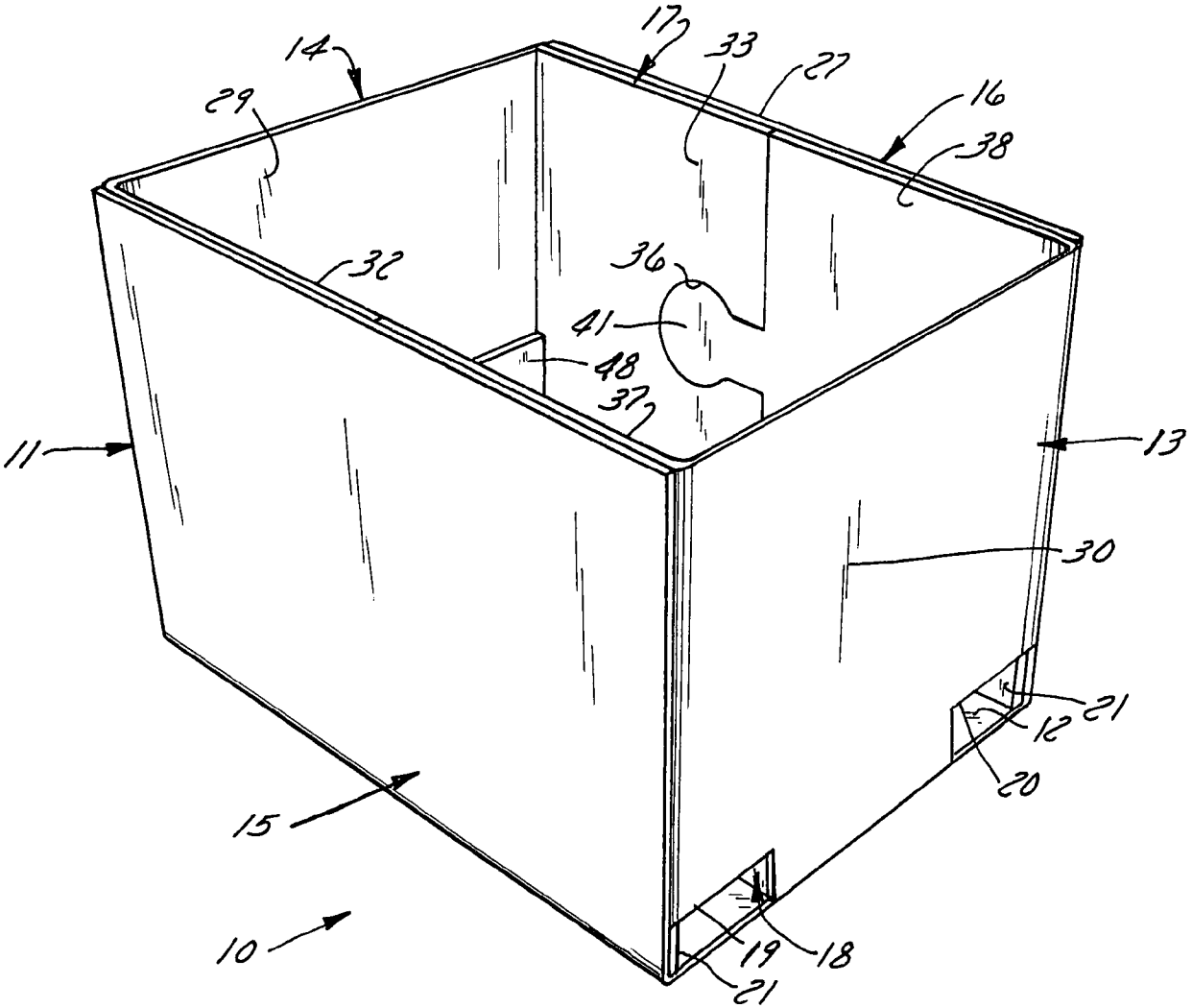
FIG. 1 is a top perspective view of a first embodiment of a container according to the invention.
Figure 2:
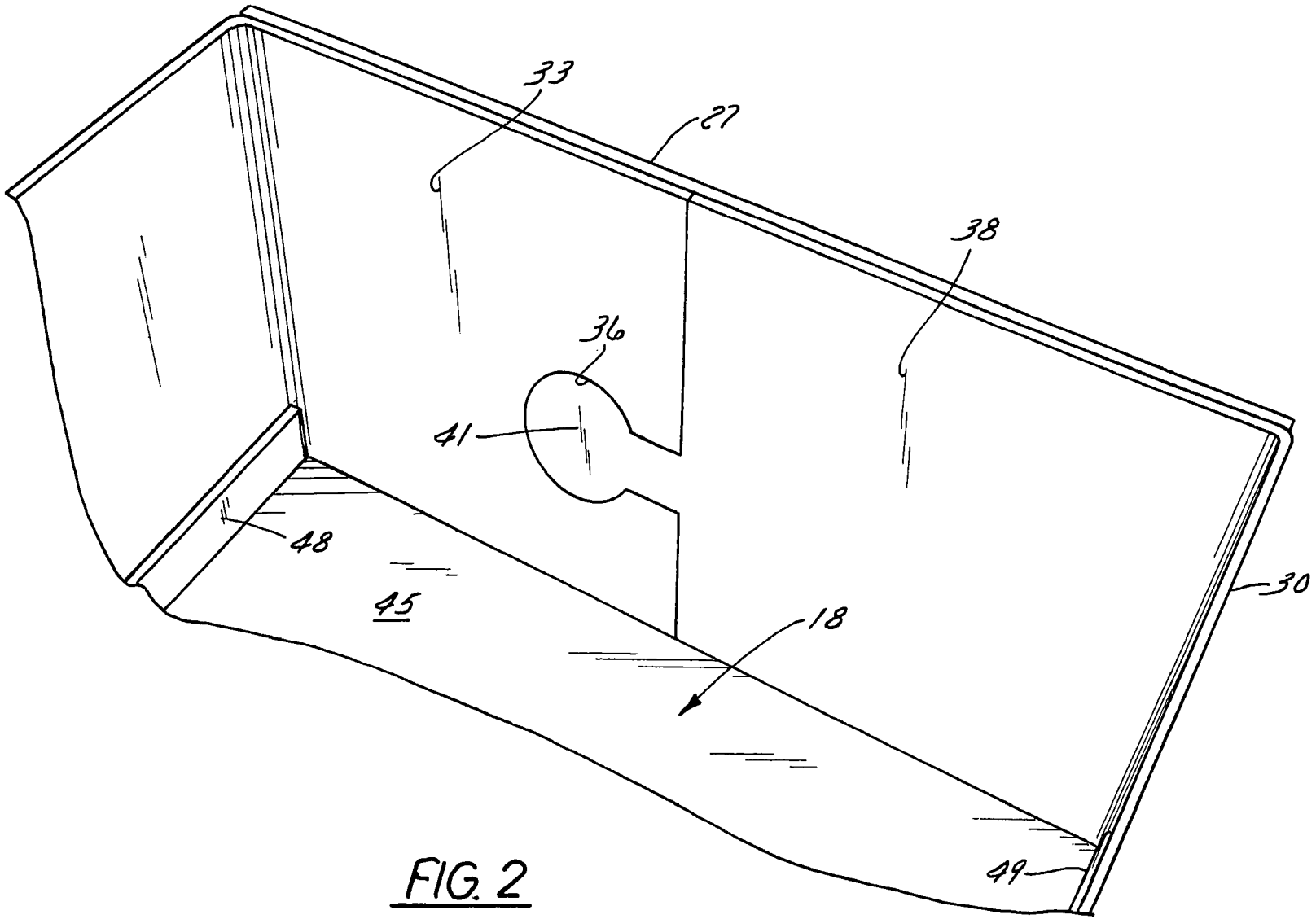
FIG. 2 is an enlarged, fragmentary top perspective view showing a portion of the interior of the container of FIG. 1.

A first embodiment of the shipping container of the invention is indicated generally at 10 in FIGS. 1-7. The container comprises a box 11 with a bottom wall 12, opposite end walls 13 and 14, opposite sidewalls 15 and 16, an open top 17, and a pallet 18 integrated into the container bottom. Openings 19 and 20 are provided in the end walls immediately above the bottom wall 12 and extending outwardly to adjacent the respective side edges of the container for receiving the tines of a forklift (not shown). Reinforcing structure 21 is provided at the outer side edges of the openings, as described in greater detail hereinafter.

A separate cover 22 (see FIG. 3) is provided for closing the open top of the container.

Figure 3:
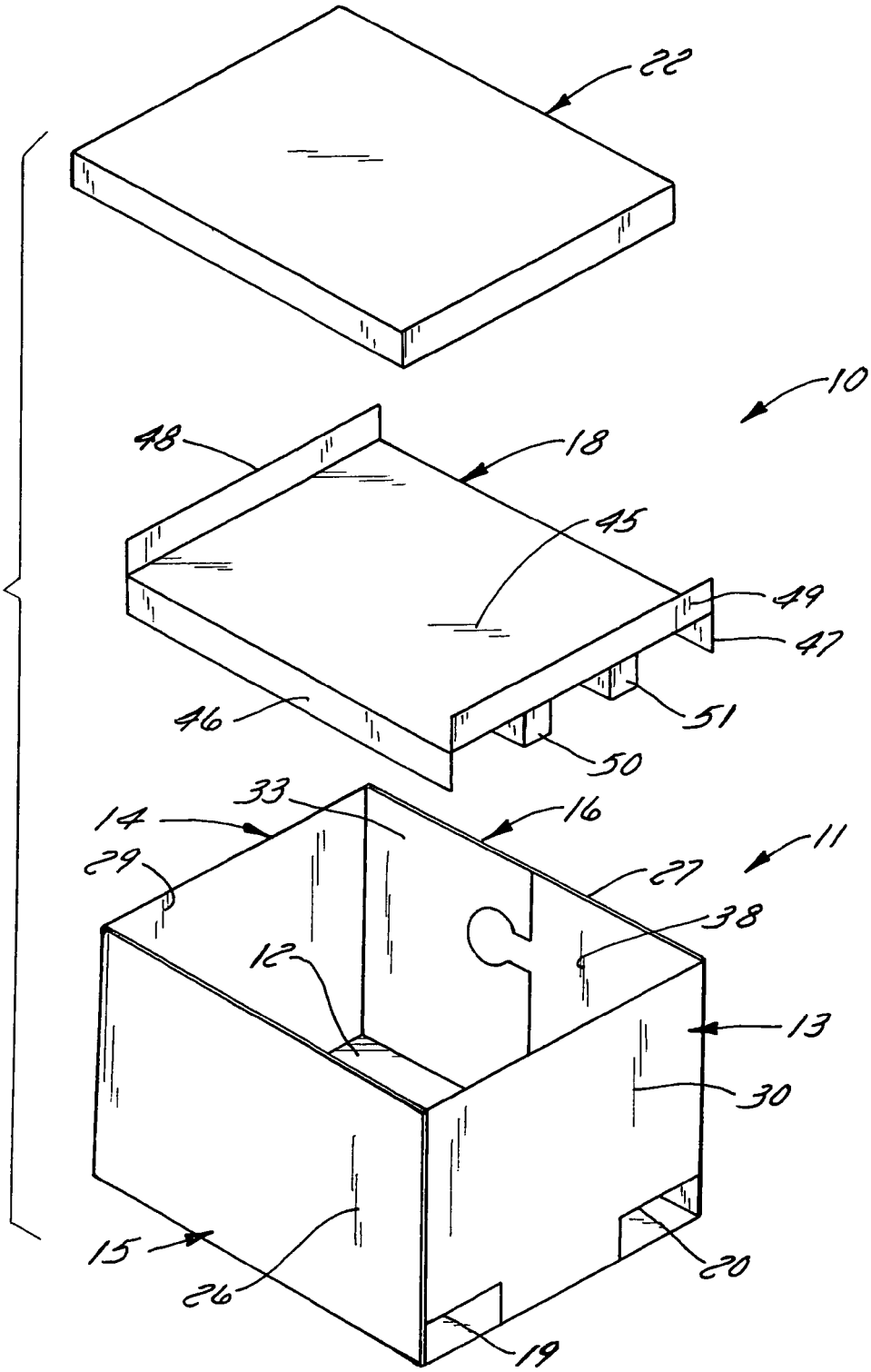
FIG. 3 is an exploded perspective view showing the major components of the container of FIG. 1.
Figure 4:
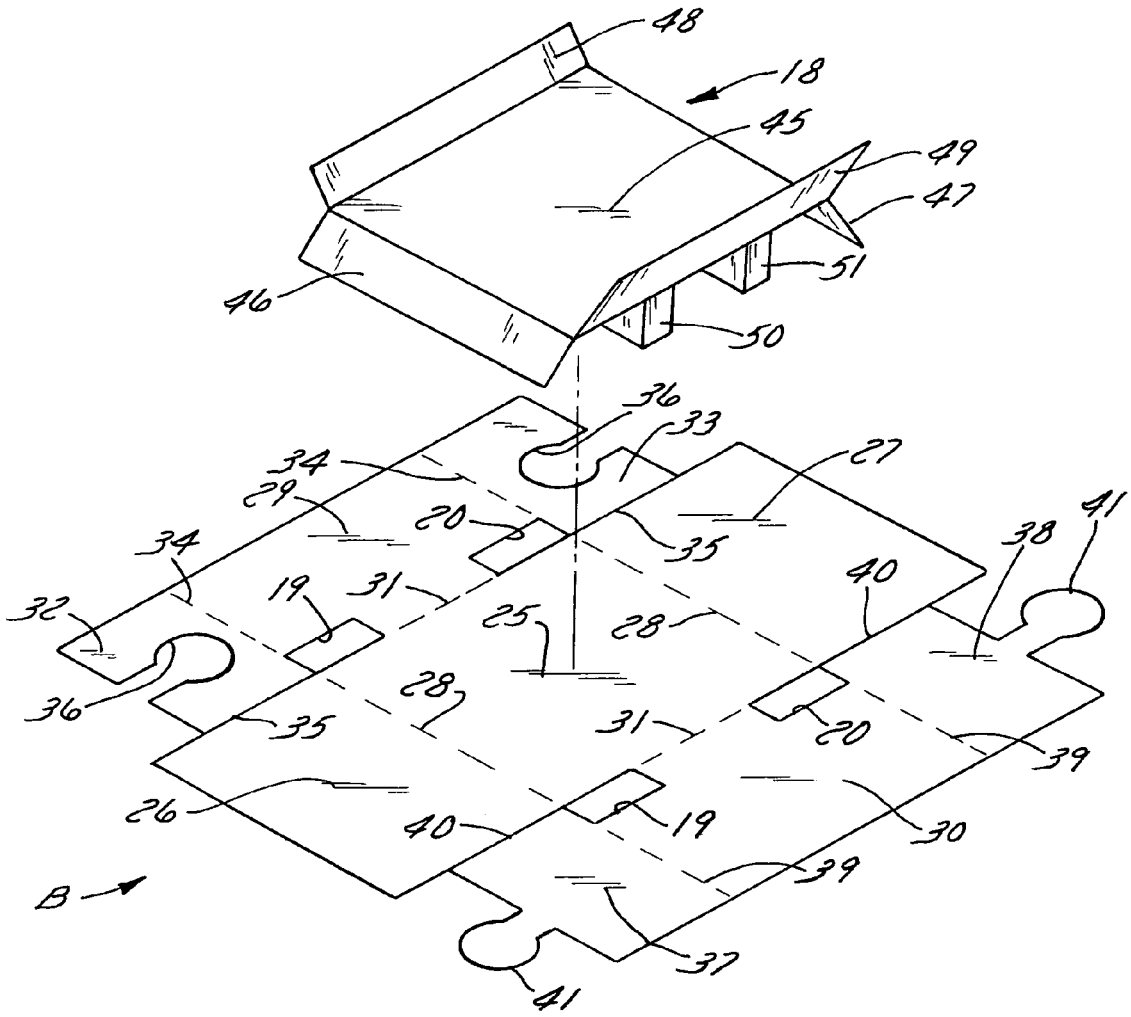
FIG. 4 is an exploded perspective view showing a pallet and blank during an early assembly stage for making the container of FIG. 1.
Figure 5:
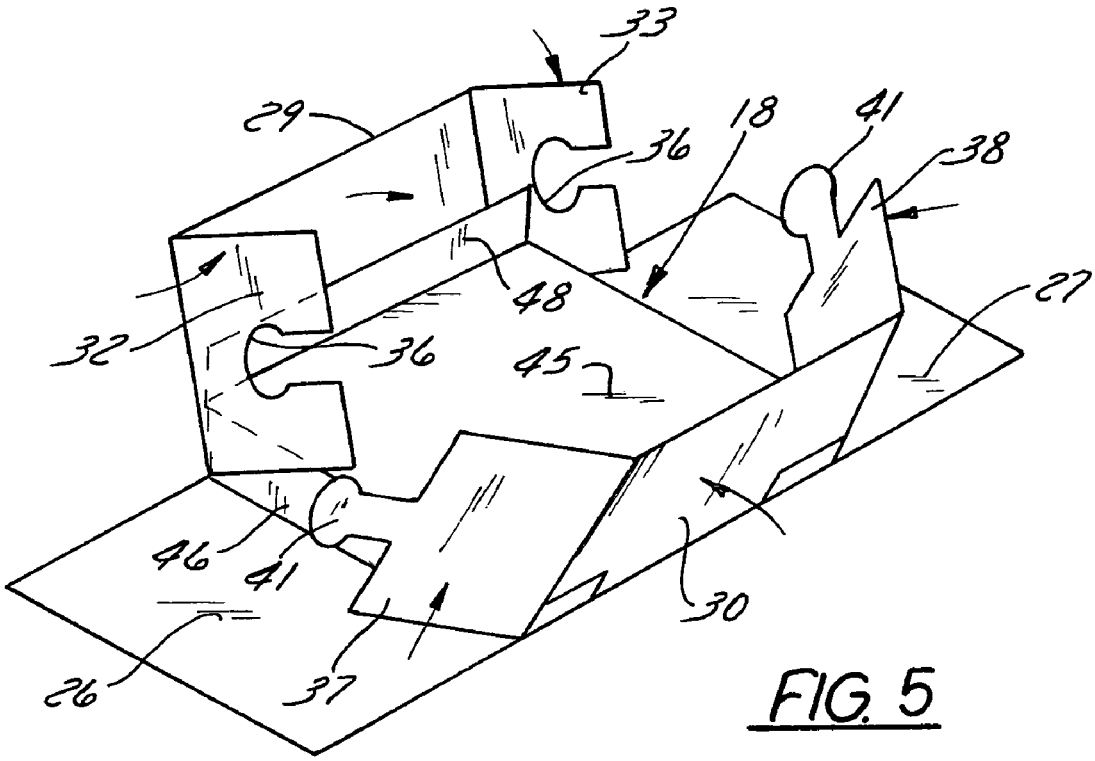
FIG. 5 is a top perspective view showing the container of FIG. 1 during a later stage of assembly.
Figure 6:
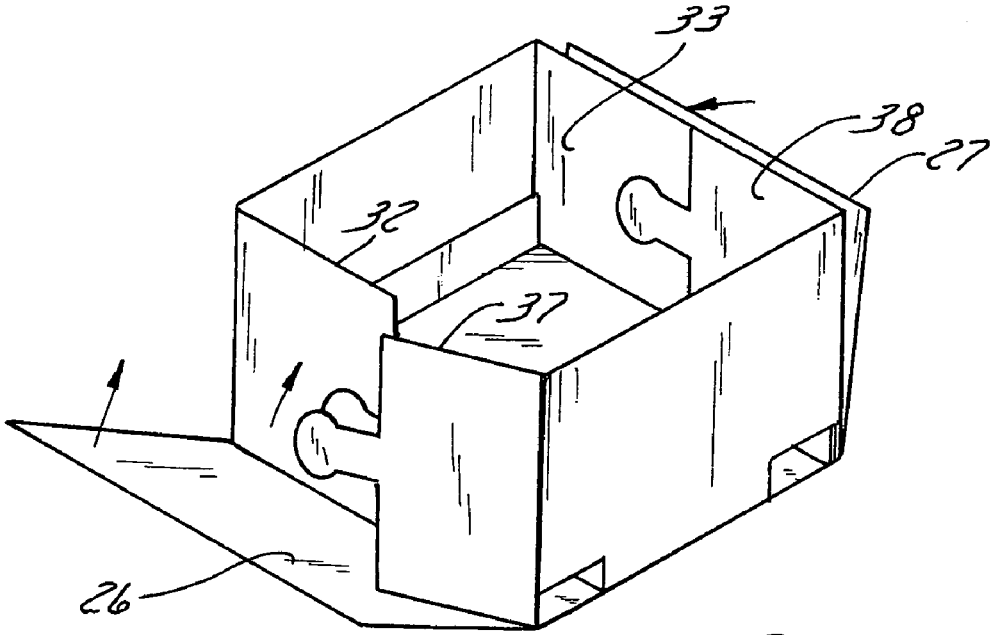
FIG. 6 is a top perspective view showing the container of FIG. 1 in a final stage of assembly.
Figure 7:
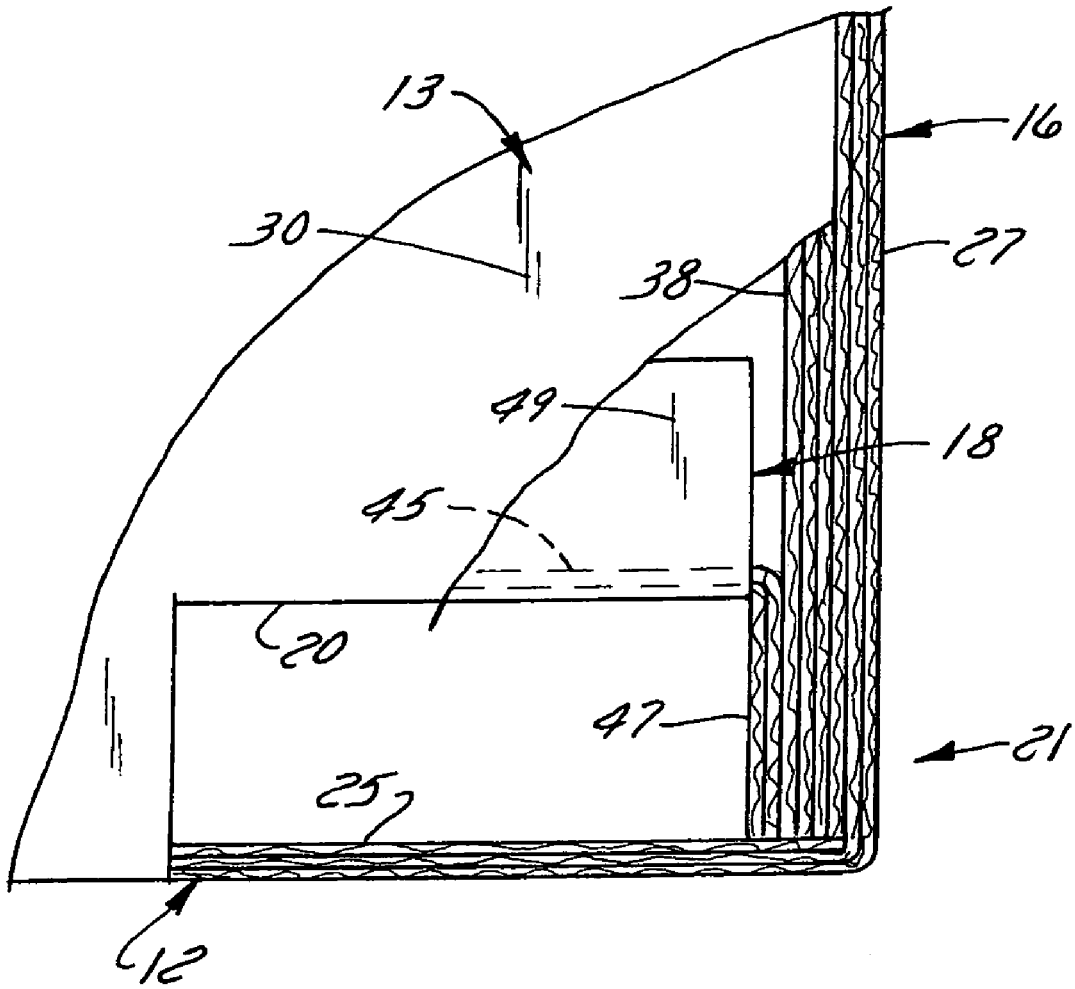
FIG. 7 is an enlarged fragmentary sectional view, with portions broken away, of a portion of a container according to the invention, showing the reinforced sidewall at the outer edge of a tine-receiving opening.

The construction of the shipping container with integrated pallet is best understood with reference to FIGS. 3-7. FIG. 3 shows the box 11, pallet 18 and cover 22 in exploded relationship; FIGS. 4-6 depict various stages in assembling the container; and FIG. 7 shows details of the reinforcing structure 21 at the outer side edges of the tine-receiving openings 19 and 20.

The box portion 11 of the container 10 is formed from a single unitary blank B, as seen best in FIG. 4, preferably of triple-ply construction. The blank B comprises a central bottom panel 25 that forms the bottom wall 12 in the completed container, opposite sidewall panels 26 and 27 foldably joined to opposite side edges of the bottom panel along respective fold lines 28 and that form outer sidewall panels in the sidewalls 15 and 16 of a completed container, and opposite end wall panels 29 and 30 foldably joined to opposite end edges of the bottom panel along respective fold lines 31 and that form the end walls 13 and 14 in the completed container.

First sidewall flaps 32 and 33 are foldably joined to opposite side edges of one of the end wall panels 29 along respective fold lines 34, and form inner sidewall panels in the completed container. The flaps are separated from the respective adjacent sidewall panels 26 and 27 by cuts 35, and a shaped cut-out 36 is formed in the outer end edge of each flap for a purpose described hereinafter.

Second sidewall flaps 37 and 38 are foldably joined to opposite side edges of the other end wall panel 30 along respective fold lines 39, and form inner sidewall panels in the completed container. The flaps are separated from the respective adjacent sidewall panels 26 and 27 by cuts 40, and a shaped projection 41 is formed on the outer end edge of each flap 37 and 38. The projections 41 are shaped complementally to the shaped cut-outs 36 in the first sidewall flaps, and when the container is erected the projections fit into the cut-outs to form an interlocking means or key-lock to prevent separation of adjacent first and second sidewall flaps from one another.

With particular reference to FIGS. 4 and 9-11, the pallet 18 comprises a pallet deck 45 having down-turned side flanges 46 and 47 foldably joined to opposite side edges thereof, and up-turned end flanges 48 and 49 foldably joined to opposite end edges. The deck and flanges are formed from a single unitary blank B1, preferably of double-ply construction. Pallet runners 50 and 51 are adhesively attached to the underside of the deck in inwardly spaced relationship to opposite side edges thereof. The pallet runners may have any suitable construction, but in the particular example shown and described herein they are made of a plurality of strips 52 of corrugated paperboard adhesively laminated together. The number of strips can be varied to achieve a pallet of desired width or thickness.

To erect the container of the invention, pallet 18, with runners 50 and 51 adhesively secured to the underside of the pallet deck and with the side flanges 46 and 47 bent downwardly and the end flanges 48 and 49 bent upwardly, is applied to the top of the bottom wall panel 25 of the container blank,. Adhesive is applied to the underside of the runners to adhesively attach them to the upper surface of the container bottom wall. Adhesive is also applied to the entire inner (or upper) surface of the sidewall panels 26 and 27 of the container and to the outer surfaces of the side flanges 46 and 47 and end flanges 48 and 49 of the pallet. The container end wall panels 29 and 30 are folded upwardly perpendicular to the bottom panel and against the outer surface of the upturned flanges 48 and 49, with the side flaps 32, 33 and 37, 38 folded inwardly parallel to the side edges of the bottom panel and against the outer surfaces of the down-turned flanges 46 and 47. The pallet is thus adhesively secured to the top of the container bottom wall via the runners, which are adhesively attached to both the pallet deck and the container bottom wall. In addition, the upturned flanges 48 and 49 are adhesively attached to the container end walls, and the down-turned flanges 46 and 47 are adhesively attached to the side flaps 32, 37 and 33, 38. The projections 41 on flaps 37 and 38 are inserted into the respective complementary cut-outs 36 in flaps 32 and 33 to provide a mechanical lock preventing separation of flap 32 from flap 37 and flap 33 from flap 38. Staples or other fasteners may be applied across the top of the sidewall panels and side flaps to hold them in place while the adhesive cures.

It will be seen that the interlocked pairs of side flaps 32, 37 and 33, 38 form inner sidewall panels at respective opposite sides of the container, and the sidewall panels 26 and 27 form outer sidewall panels at respective opposite sides of the container. Further, the down-turned side flanges on the pallet are secured to the inner surface of the sidewall flaps, or inner sidewall panels, thus forming a triple wall construction at opposite sides of the container, extending downwardly from the pallet deck to the container bottom. Since the container is made of triple-ply material and the pallet deck is made of double-ply material, in a preferred example, there are six plies of material in the bottom edges of the sidewalls at the outer side edges of the tine-receiving openings 19 and 20, forming a structure that is as strong or nearly as strong as a runner if placed in the same location. See FIG. 7.

Figure 12:
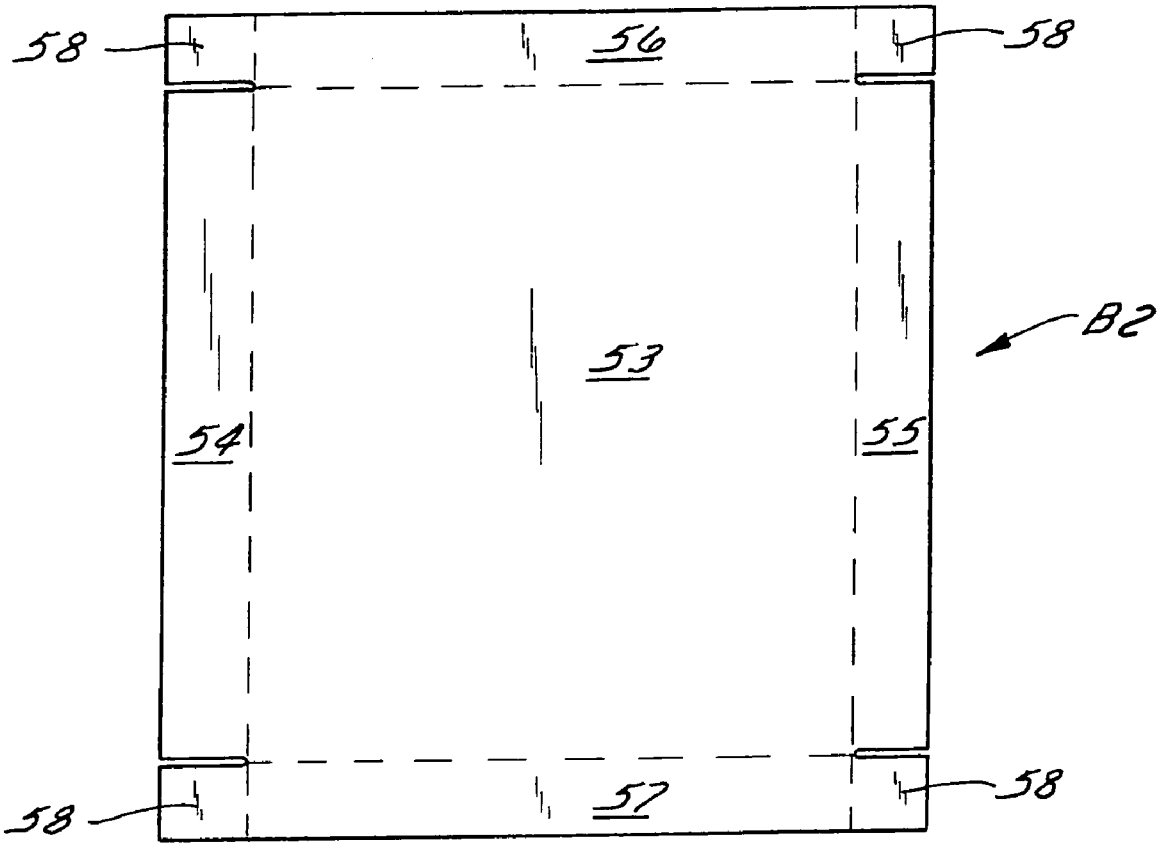
FIG. 12 is a top plan view of a blank for making the cover for the container of the invention.

A blank B2 for making the cover 22 is shown in FIG. 12. The blank includes a center panel 53, with side flanges 54, 55 and end flanges 56, 57 foldably joined to respective opposite side and end edges. Glue tabs 58 are provided on opposite ends of the side or end flanges (the end flanges in the example shown) to hold the side and end flanges in positions folded perpendicular to the panel 53.

Figure 8:
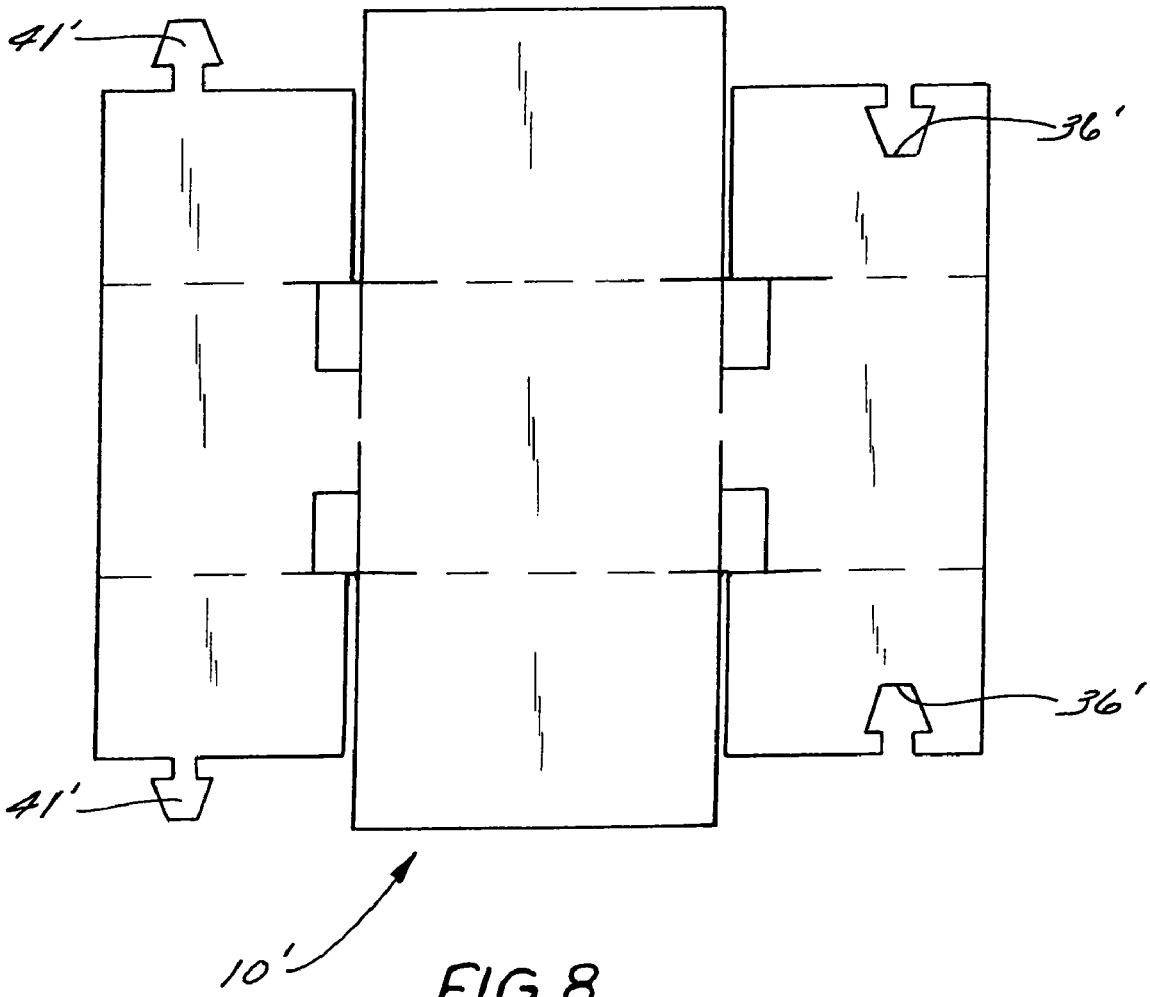
FIG. 8 is a top plan view of a blank for making an alternate embodiment of the container of the invention, wherein the interlocking means is rectilinear rather than rounded as in the FIG. 1 embodiment.
Figure 9:
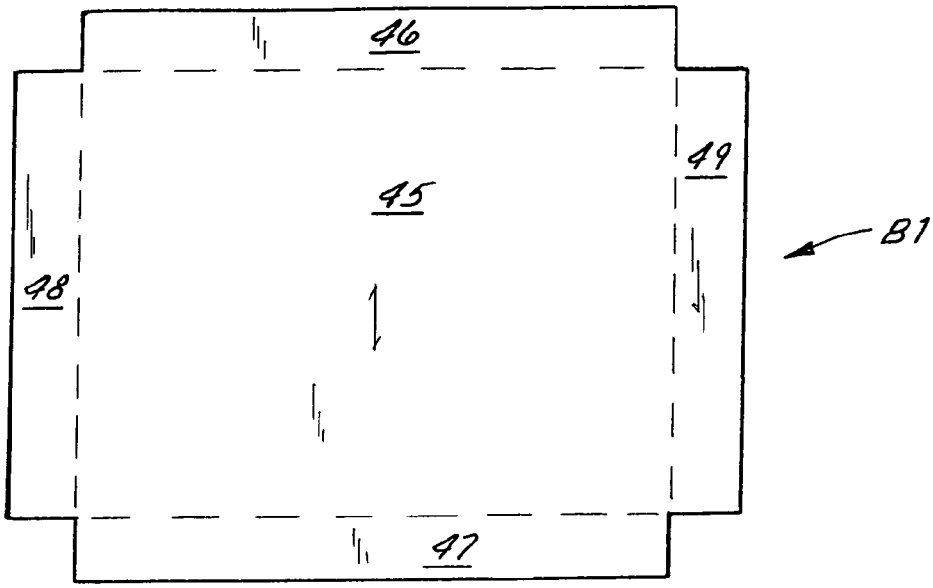
FIG. 9 is a top plan view of a blank for making the pallet deck and pallet flanges used in the container of the invention.
Figure 10:
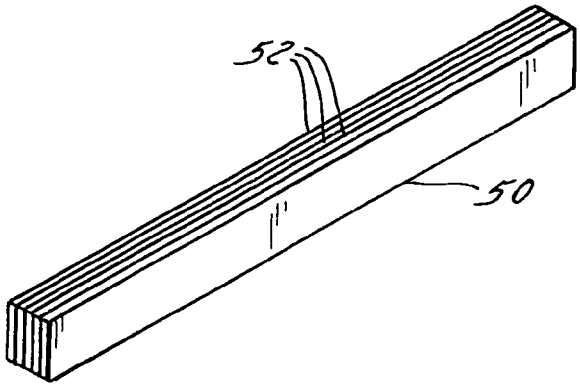
FIG. 10 is a top perspective view of a runner for use in the pallet of the invention, showing multiple strips of material laminated together to form the runner.
Figure 11:
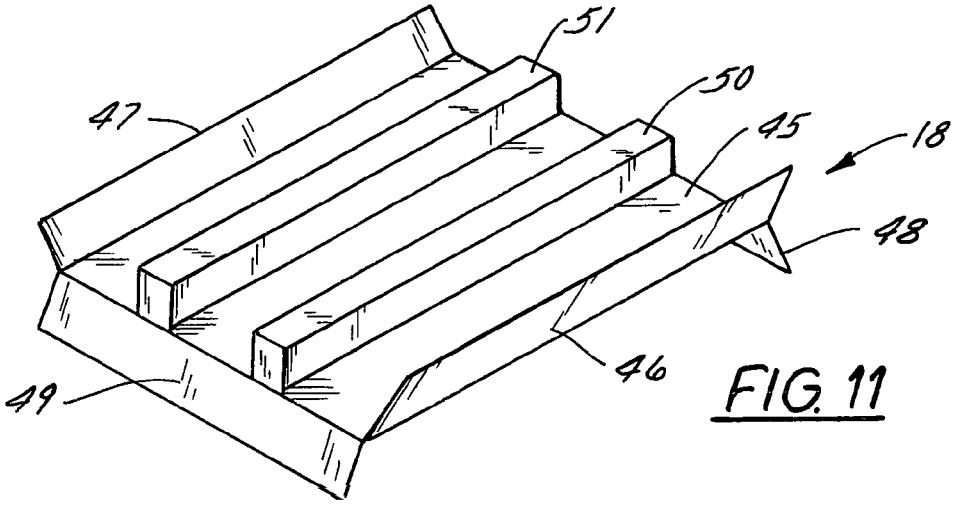
FIG. 11 is a bottom perspective view of the pallet used in the embodiment of the invention shown in FIG. 1.

An alternate embodiment of the invention is indicated at 10' in FIG. 8. This embodiment is identical to that described above, except that the projections 41' and complementary cut-outs 36' are rectilinear rather than rounded as in the first embodiment. In the particular example shown, the projections have a trapezoidal shape, but any other shape could be provided that achieves interlocking of the side flaps.

A further embodiment is indicated at 60 in FIGS. 13-18, wherein the container is, designed for four-way entry of the tines of a forklift. The container in this embodiment incorporates the same inventive features as in the previous embodiments, i.e., it has an integrated pallet and a narrow width dimension so that three of the containers can be placed side-by-side in a standard sea container, it has the interlocking structure on the inner wall panels, and the outermost pallet runners, which extend in the length dimension of the container, are inset relative to the outer side edges of the container so that the tine-receiving openings will accommodate the tines of a forklift at their normal setting. Thus, the container 60 has substantially the same width dimension W as the embodiments described above, e.g., 30 inches, but it is elongated in the length dimension L, e.g., it has a length of 47 inches compared with a length of 36 inches in the previous embodiments. In this regard, it should be understood that the containers of all embodiments disclosed herein could have other width and length dimensions as suitable for an intended use or purpose.

Figure 13:
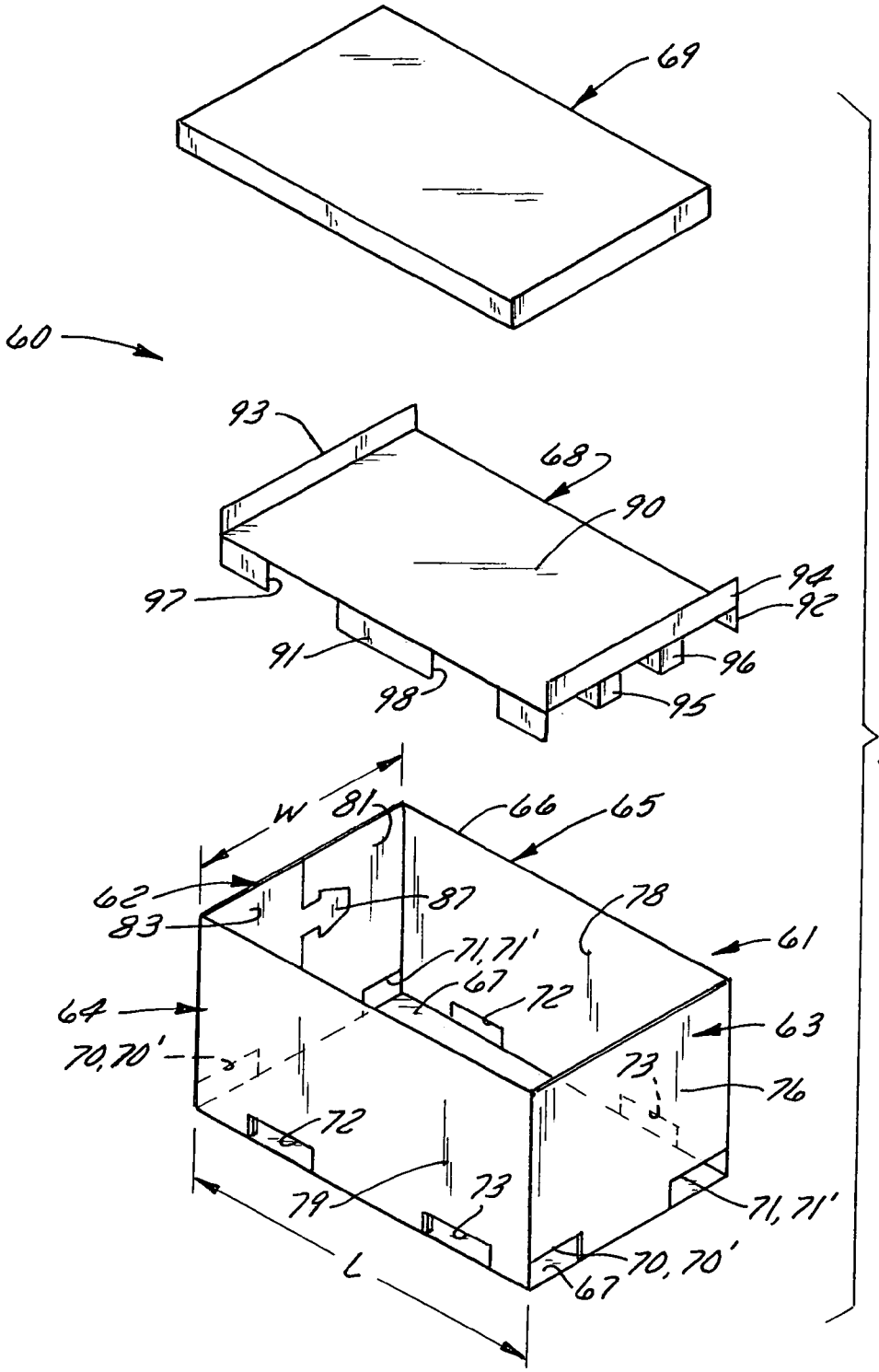
FIG. 13 is a top perspective exploded view of a container, pallet and cover according to a further embodiment of the invention, wherein the container is designed for four-way entry of the tines of a forklift.
Figure 18:
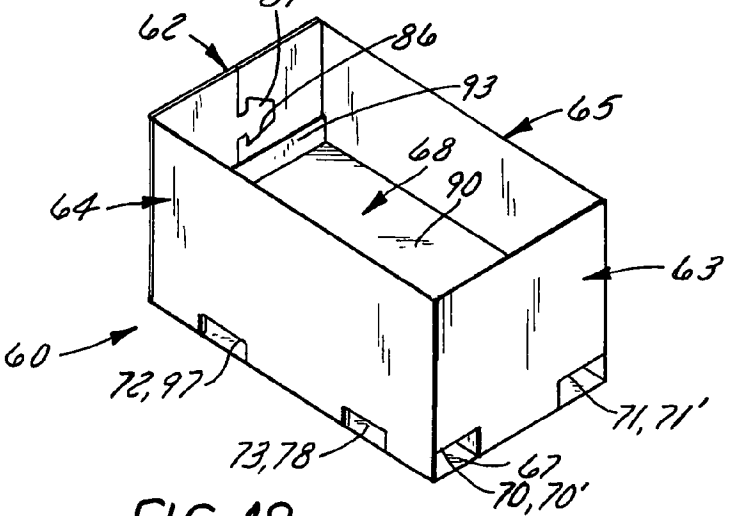
FIG. 18 is a top perspective view of the container of FIG. 13, shown fully assembled.
Figure 15:
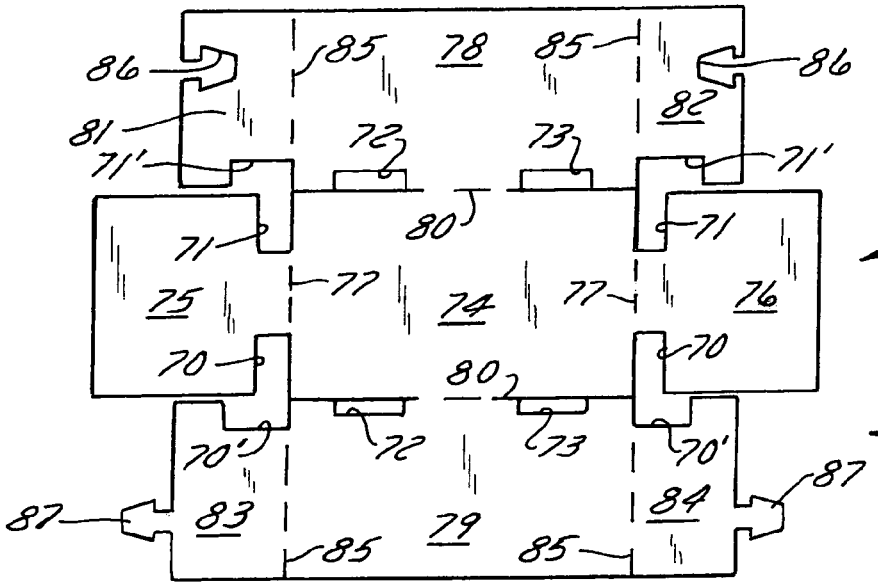
FIG. 15 is a top plan view of a blank for making the container of FIG. 13.
Figure 16:
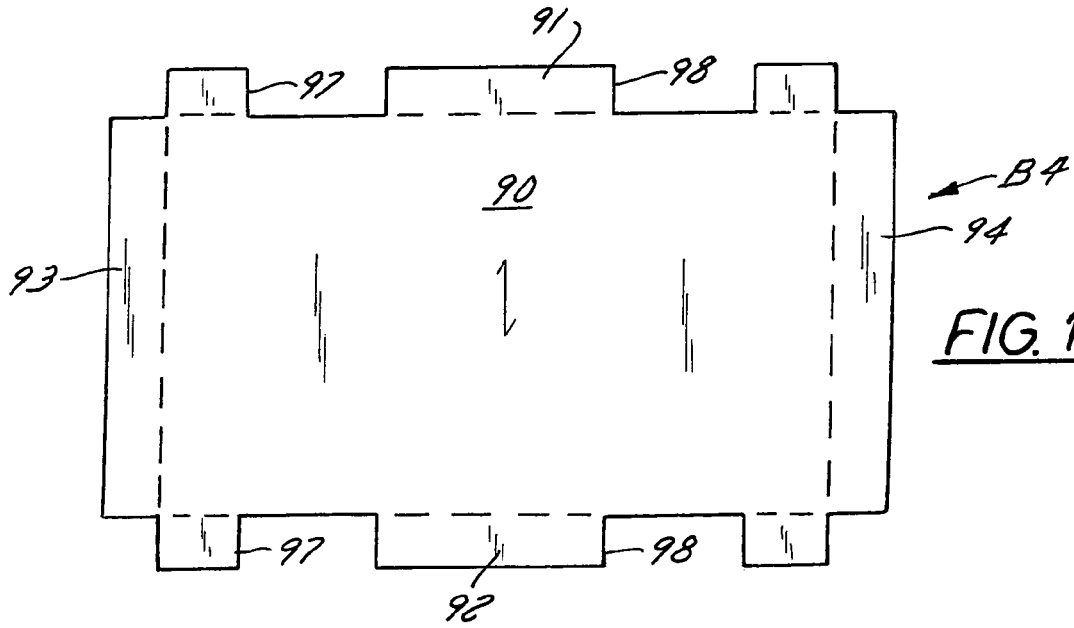
FIG. 16 is a top plan view of a blank for making the pallet deck of the pallet shown in FIG. 14.
Figure 17:
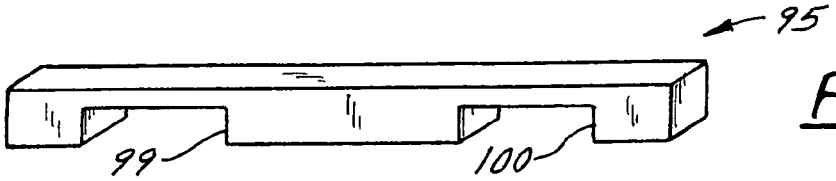
FIG. 17 is a perspective view of a runner as used in the pallet of FIG. 14.

With particular reference to FIGS. 13 and 18, the container 60 comprises a box 61 having opposite end walls 62 and 63, opposite sidewalls 64 and 65, an open top 66, a bottom wall 67, a pallet 68 integrated into its bottom, and a cover 69. First tine-receiving openings 70 and 71 are provided in each of the end walls at their outer side edges immediately above the bottom 67, and second tine-receiving openings 72 and 73 are provided in each of the sidewalls, spaced inwardly from opposite ends of the container. The spacing between the respective pairs of openings corresponds to the spacing between the tines of a forklift when they are set to handle conventional containers, as discussed previously herein. Thus, the spacing between openings 72 and 73 is the same as the spacing between openings 70 and 71.

The box 61 is made from a single unitary blank B3 (FIG. 15), preferably of triple-ply construction, and having an elongate central bottom wall panel 74, end wall panels 75 and 76 foldably joined to respective opposite ends thereof along fold lines 77, sidewall panels 78 and 79 foldably joined to respective opposite sides thereof along fold lines 80, and end wall flaps 81, 82 and 83, 84 foldably joined along fold lines 85 to respective opposite ends of respective sidewall panels 78 and 79. It will be noted that in this embodiment of the invention the flaps 81, 82 and 83, 84 are foldably connected to the sidewall panels 78 and 79, rather than to the end wall panels as in the prior embodiments, and that the flaps comprise inner wall panels in the end walls of the container rather than in the sidewalls. Thus, the end walls rather than the sidewalls are of double-wall construction, having inner wall panels and outer wall panels.

Shaped cut-outs 86 are made in the end edges of end wall flaps 81 and 82, and correspondingly shaped projections 87 are formed on the end edges of end wall flaps 83 and 84. Although the shaped cut-outs and correspondingly shaped projections are shown as being rectilinear, with a trapezoidal shape, they could equally as well have the rounded shape of the first embodiment, or any other suitable shape that will function to lock the flaps together as described in relation to the previous embodiments. Further, due to the location of the flaps 81, 82 and 83, 84 on the sidewall panels rather than the end wall panels, and the fact that they form inner wall panels in the end walls of the container, cut-outs 70' and 71' are made in the bottom edges of these flaps adjacent the fold lines 85, whereby when the flaps are folded into operative relationship in a container erected from the blank, the openings 70' and 71' are in registry with the openings 70 and 71 in the end wall panels.

Figure 14:
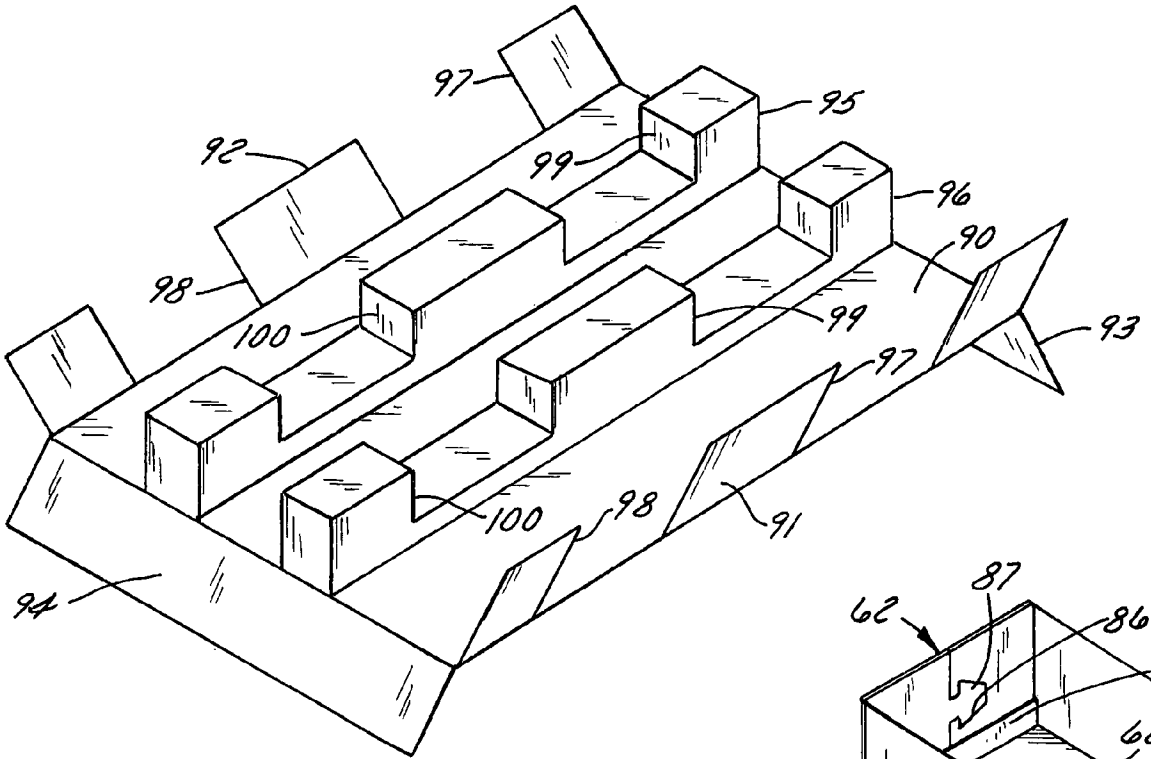
FIG. 14 is a bottom perspective view of the pallet in the container of FIG. 13.

With particular reference to FIGS. 13 and 14, the pallet 68 comprises a pallet deck 90 having down-turned side flanges 91 and 92 foldably joined to opposite side edges thereof, and up-turned end flanges 93 and 94 foldably joined to opposite end edges. The deck and flanges are formed from a single unitary blank B4, preferably of double-ply construction. Pallet runners 95 and 96 are adhesively attached to the underside of the deck in inwardly spaced relationship to opposite side edges thereof. The pallet runners may have any suitable construction, such as, for example, that described in relation to the first embodiment. Pallet 68 differs from pallet 18 primarily in that is more elongate and has cut-outs or notches 97, 98 in the bottoms of the side flanges 91 and 92, and notches 99, 100 in the underside of the runners 95 and 96. The notches in the flanges 91 and 92 and in the runners 95 and 96 are in alignment with one another and with the openings 72, 73 in sidewall panels 78 and 79, for receiving the tines of a forklift or other tool for handling the container.

With the exception of the relocation of the flaps 81, 82 and 83, 84 to the end walls, the box 61 is erected identically to the box 11 in the first form of the invention.

While particular embodiments of the invention have been illustrated and described in detail herein, it should be understood that various changes and modifications may be made in the invention without departing from the spirit and intent of the invention as defined by the appended claims.

While the invention has been described and illustrated with reference to one or more preferred embodiments thereof, it is not the intention of the applicants that the invention be restricted to such detail. Rather, it is the intention of the applicants that the invention be defined by all equivalents, both suggested hereby and known to those of ordinary skill in the art, of the preferred embodiments falling within the scope hereof.

The invention claimed is:

1. A shipping container, comprising:

a box having a bottom wall, opposite sidewalls, and opposite end walls;

a pallet integrated into a bottom portion of the box, above the bottom wall and between the sidewalls and end walls, said pallet comprising a pallet deck in spaced relation to the bottom wall, and pallet runners secured to the deck and extending between the deck and the bottom wall in spaced relation to opposite side edges of the container;

side flanges are on opposite side edges of said pallet deck, said side flanges extending between said pallet deck and said bottom wall and secured to an inner surface of a respective adjacent said sidewall, said side flanges reinforcing said sidewalls where they extend between said pallet deck and said bottom wall;

end flanges are on opposite end edges of said pallet deck, said end flanges extending upwardly from said pallet deck and secured to an inner surface of a respective adjacent said end wall; and tine-receiving openings in said end walls, said tine-receiving openings being located outwardly of said pallet runners, between said pallet runners and adjacent sidewalls of said container and between said pallet deck and said bottom wall.

2. A shipping container as claimed in claim 1, wherein: said pallet runners are secured to both said pallet deck and said bottom wall.

3. A shipping container as claimed in claim 1, wherein:

said box is made from a single unitary blank of corrugated paperboard of triple-ply construction; and said pallet deck, including said side and end flanges, is made from a single unitary blank of corrugated paperboard of double-ply construction.

4. A shipping container as claimed in claim 1, wherein:

said tine-receiving openings are in both said end walls and said sidewalls for four-way entry of the tines of a forklift.

5. A shipping container as claimed in claim 4, wherein:

the tine-receiving openings in the sidewalls are spaced inwardly from opposite ends of the box; and the tine-receiving openings in the sidewalls are spaced apart the same distance as the spacing between the openings in the end walls.

6. A shipping container as claimed in claim 5, wherein:

side flanges are on opposite side edges of said pallet deck, said side flanges extending between said pallet deck and said hex bottom wall and secured to an inner surface of a respective adjacent said sidewall, said side flanges reinforcing said hex sidewalls where they extend between said pallet deck and said box bottom wall; and said side flanges are notched in areas in alignment with said tine-receiving openings in said sidewalls.

7. A shipping container as claimed in claim 6, wherein:

end flanges are on opposite end edges of said pallet deck, said end flanges extending upwardly from said pallet deck and secured to an inner surface of a respective adjacent said end wall.

8. A shipping container as claimed in claim 7, wherein:

said pallet runners are secured to both said pallet deck and said bottom wall.

9. A shipping container as claimed in claim 8, wherein:

said box is made from a single unitary blank of corrugated paperboard of triple-ply construction; and said pallet deck, including said side flanges and said end flanges, is made from a single unitary blank of corrugated paperboard of double-ply construction.

10. A shipping container as claimed in claim 1, wherein:

said sidewalls comprise inner wall panels and outer wall panels laminated together, and said inner wall panels comprise side flaps foldably connected to said end walls, said side flaps having adjacent confronting end edges, and interlocking structures on said confronting end edges for locking said side flaps together to prevent separation thereof.

11. A shipping container as claimed in claim 1, wherein:

said end walls comprise inner wall panels and outer wall panels laminated together, and said inner wall panels comprise end flaps foldably connected to said sidewalls, said end flaps having adjacent confronting end edges, and interlocking structures on said confronting end edges for locking said end flaps together to prevent separation thereof.

12. A shipping container, comprising:

a box having a bottom wall, opposite sidewalls, and opposite end walls;

one of said sidewalls and said end walls comprising inner wall panels and outer wall panels laminated together, said inner wall panels comprising flaps foldably connected to the other of said sidewalls and end walls, said flaps having adjacent confronting end edges, and interlocking structures on said confronting end edges for locking said flaps together to resist separation thereof;

said inner wall panels and outer wall panels are in said sidewalls, and said flaps comprise side flaps foldably joined to the end walls;

a pallet is integrated into a bottom portion of the box, above the bottom wall and between the sidewalls and end walls, said pallet comprising a pallet deck extend in parallel to and in spaced relation to the box bottom wall, and pallet runners secured to an underside of the deck and extending between the deck and the bottom wall in parallel relation to the sidewalls and in inwardly spaced relation to opposite side edges of the container; tine-receiving openings are in said end walls for receiving the tines of a forklift, said tine-receiving openings being located outwardly of said runners, between said pallet runners and adjacent sidewalk of said container and between said pallet deck and said box bottom wall; and side flanges are on opposite side edges of said pallet deck, said side flanges extending between said pallet deck and said bottom wall and secured to an inner surface of a respective adjacent said sidewall, said side flanges reinforcing said sidewalls where the extend between said pallet deck and said bottom wall.

13. A shipping container as claimed in claim 12, wherein:

said inner wall panels and outer wall panels are in said end walls, and said flaps comprise end flaps foldably joined to the sidewalls.

* * * * *

UNITED STATES PATENT AND TRADEMARK OFFICE

CERTIFICATE OF CORRECTION

PATENT NO. : 7,597,194 B2
APPLICATION NO. : 11/435311
DATED : October 6, 2009
INVENTOR(S) : Eric John Oberliesen et al.

It is certified that error appears in the above-identified patent and that said Letters Patent is hereby corrected as shown below:

Column 9 Claim 6, lines 1-6 should be corrected as follows:

said bottom wall and secured to an inner surface of a respective adjacent said sidewall, said side flanges reinforcing said sidewalls where they extend between said pallet deck and said bottom wall; and said side flanges are notched in areas in alignment with said time-receiving openings in said sidewalls.

Column 10 Claim 12, lines 14-26 should be corrected as follows:

a pallet is integrated into a bottom portion of the box, above the bottom wall and between the sidewalls and end walls, said pallet comprising a pallet deck extending parallel to and in spaced relation to the box bottom wall, and pallet runners secured to an underside of the deck and extending between the deck and the bottom wall in parallel relation to the sidewalls and in inwardly spaced relation to opposite side edges of the container; tine-receiving openings are in said end walls for receiving the tines of a forklift, said tine-receiving openings being located outwardly of said runners, between said pallet runners and adjacent sidewalls of said container and between said pallet deck and said box bottom wall; and Signed and Sealed this Ninth Day of February, 2010

David J. Kappos

David J. Kappos
*Director of the United States Patent and Trademark Office*